US010704336B2

(12) United States Patent
Bradshaw et al.

(10) Patent No.: US 10,704,336 B2
(45) Date of Patent: Jul. 7, 2020

(54) EARTH BORING TOOLS HAVING FIXED BLADES, ROTATABLE CUTTING STRUCTURES, AND STABILIZING STRUCTURES AND RELATED METHODS

(71) Applicants: Baker Hughes, a GE company, LLC, Houston, TX (US); OXY USA INC, Houston, TX (US)

(72) Inventors: Robert Bradshaw, Spring, TX (US); Roger Lee, Muscat (OM); Eric E. McClain, Spring, TX (US); Saleh Al Esry, Muscat (OM)

(73) Assignees: Baker Hughes, a GE company, LLC, Houston, TX (US); Oxy USA Inc., Houston, TX (US)

( * ) Notice: Subject to any disclaimer, the term of this patent is extended or adjusted under 35 U.S.C. 154(b) by 0 days.

(21) Appl. No.: 15/819,185

(22) Filed: Nov. 21, 2017

(65) Prior Publication Data

US 2019/0153786 A1 May 23, 2019

(51) Int. Cl.

| | |
|---|---|
| ***E21B 10/42*** | (2006.01) |
| ***E21B 12/00*** | (2006.01) |
| ***E21B 10/14*** | (2006.01) |
| *E21B 10/567* | (2006.01) |

(52) U.S. Cl.

CPC ..... *E21B 12/00* (2013.01); *E21B 10/14* (2013.01); *E21B 10/42* (2013.01); *E21B 10/567* (2013.01)

(58) Field of Classification Search

CPC combination set(s) only.

See application file for complete search history.

(56) References Cited

U.S. PATENT DOCUMENTS 2,198,849 A * 4/1940 Waxler ..... E21B 10/14 175/336
5,058,689 A * 10/1991 Collinsworth ..... E21B 10/46 175/325.4
5,103,922 A * 4/1992 Jones ..... E21B 10/55 175/421

(Continued)

OTHER PUBLICATIONS

International Written Opinion for International Application No. PCT/US2018/061341 dated Mar. 12, 2019, 6 pages.

(Continued)

*Primary Examiner* — Giovanna C Wright
*Assistant Examiner* — Ronald R Runyan
(74) *Attorney, Agent, or Firm* — TraskBritt

(57) ABSTRACT

An earth-boring tool includes a body having a shank and a crown, a plurality of blades protruding from the crown of the body and extending at least substantially along a longitudinal length of the crown of the body, each blade extending radially outward and defining a respective radially outermost gage surface. The earth-boring tool further includes at least one rotatable cutting structure assembly including a leg and a rotatable cutting structure rotatably coupled to the leg. The earth-boring tool also includes at least one stabilizing structure secured to the crown of the body between an end of the leg opposite the rotatable cutting structure and the shank of the body, the at least one stabilizing structure being at least substantially circumferentially aligned with the leg of the at least one rotatable cutting structure assembly along a circumference of the crown of the body.

15 Claims, 4 Drawing Sheets

(56) References Cited

U.S. PATENT DOCUMENTS

| | | | | |
|---|---|---|---|---|
| 5,289,889 | A * | 3/1994 | Gearhart | E21B 10/06 175/325.5 |
| 7,013,997 | B2 * | 3/2006 | Vail, III | E21B 7/065 166/386 |
| 7,341,119 | B2 | 3/2008 | Singh et al. | |
| 7,845,437 | B2 * | 12/2010 | Bielawa | E21B 10/28 175/357 |
| 8,191,635 | B2 * | 6/2012 | Buske | E21B 10/28 166/335 |
| 8,869,919 | B2 | 10/2014 | Chen et al. | |
| 9,033,069 | B2 | 5/2015 | Zhang | |
| 9,670,736 | B2 | 6/2017 | Zahradnik et al. | |
| 2010/0089649 | A1 * | 4/2010 | Welch | E21B 10/43 175/61 |
| 2010/0288561 | A1 * | 11/2010 | Zahradnik | E21B 10/00 175/336 |
| 2014/0151131 | A1 | 6/2014 | Zahradnik et al. | |
| 2015/0101868 | A1 | 4/2015 | Tedeschi et al. | |

OTHER PUBLICATIONS

International Search Report for International Application No. PCT/US2018/061341 dated Mar. 12, 2019, 3 pages.

* cited by examiner

EARTH BORING TOOLS HAVING FIXED BLADES, ROTATABLE CUTTING STRUCTURES, AND STABILIZING STRUCTURES AND RELATED METHODS

TECHNICAL FIELD

This disclosure relates generally to earth boring tools having blades with fixed cutting elements as well as rotatable cutting structures mounted to the body thereof and at least one stabilizing structure.

BACKGROUND

Oil and gas wells (wellbores) are usually drilled with a drill string. The drill string includes a tubular member having a drilling assembly that includes a single drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and/or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore.

BRIEF SUMMARY

Some embodiments of the present disclosure include earth-boring tools. The earth-boring tools may include a body having a shank and a crown, a plurality of blades protruding from the crown of the body and extending at least substantially along a longitudinal length of the crown of the body, each blade extending radially outward and defining a respective radially outermost gage surface, and at least one rotatable cutting structure assembly coupled to the crown of the body and including: a leg extending from the body of the earth-boring tool and a rotatable cutting structure rotatably coupled to the leg. The earth-boring tool may also at least one stabilizing structure secured to the crown of the body between an end of the leg opposite the rotatable cutting structure and the shank of the body, the at least one stabilizing structure being at least substantially circumferentially aligned with the leg of the at least one rotatable cutting structure assembly along a circumference of the crown of the body.

In additional embodiments, the earth-boring tool may include a body including a shank and a crown; and a plurality of blades protruding from the crown of the body and extending at least substantially along a longitudinal length of the crown of the body, each blade extending radially outward and defining a respective radially outermost gage surface. The earth-boring tool may further include a first rotatable cutting structure assembly coupled to the crown of the body and including: a first leg extending from the body of the earth-boring tool and a first rotatable cutting structure rotatably coupled to the first leg and a second rotatable cutting structure assembly coupled to the crown of the body and including: a second leg extending from the body of the earth-boring tool and a second rotatable cutting structure rotatably coupled to the second leg. The earth-boring tool may also include a first stabilizing structure secured to the crown of the body between an end of the first leg opposite the first rotatable cutting structure and the shank of the body, the first stabilizing structure being at least substantially circumferentially aligned with the first leg of the first rotatable cutting structure assembly along a circumference of the crown of the body and a second stabilizing structure secured to the crown of the body between an end of the second leg opposite the second rotatable cutting structure and the shank of the body, the second stabilizing structure being at least substantially circumferentially aligned with the second leg of the second rotatable cutting structure assembly along the circumference of the crown of the body.

Some embodiments of the present disclosure include a method of forming an earth-boring tool. The method may include forming a body of the earth-boring tool comprising a shank and a crown, forming the body to have a plurality of blades protruding from the crown of the body and extending at least substantially along a longitudinal length of the crown of the body, coupling a rotatable cutting structure to a leg of a rotatable cutting structure assembly of the earth-boring tool; and forming at least one stabilizing structure on the crown of the body between an end of the leg opposite the rotatable cutting structure and the shank of the body, the at least one stabilizing structure being at least substantially circumferentially aligned with the leg of the rotatable cutting structure assembly along a circumference of the crown of the body.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
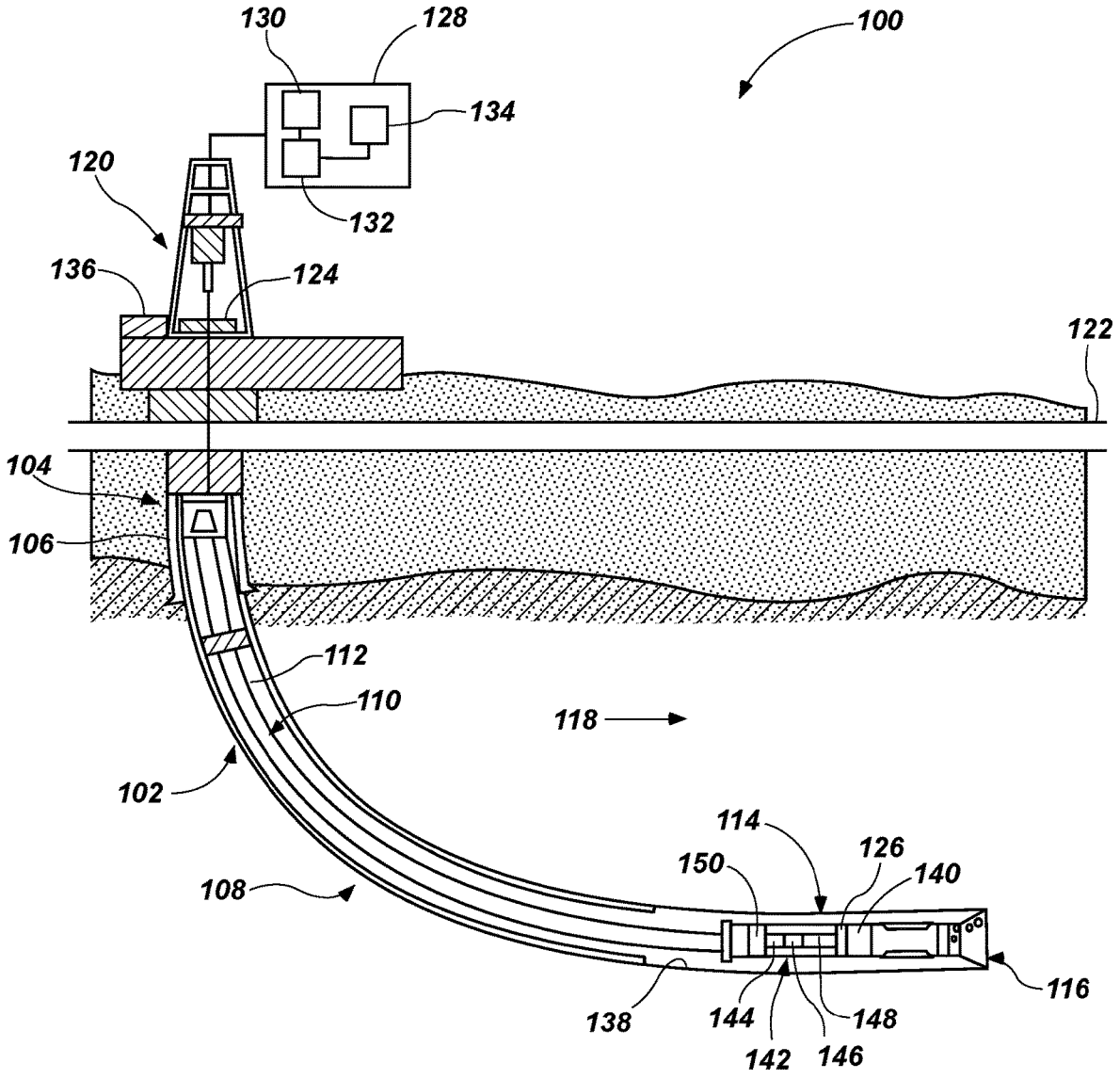
FIG. 1 is a schematic diagram of a wellbore system comprising a drill string that includes an earth-boring tool according to one or more embodiments of the present disclosure.

The illustrations presented herein are not actual views of any drill bit, roller cutter, or any component thereof, but are merely idealized representations, which are employed to describe the present invention.

As used herein, the terms "bit" and "earth-boring tool" each mean and include earth-boring tools for forming, enlarging, or forming and enlarging a borehole. Non-limiting examples of bits include fixed cutter (drag) bits, fixed cutter coring bits, fixed cutter eccentric bits, fixed cutter bi-center bits, fixed cutter reamers, expandable reamers with blades bearing fixed cutters, and hybrid bits including both fixed cutters and rotatable cutting structures (roller cones).

As used herein, the term "cutting structure" means and include any element that is configured for use on an earth-boring tool and for removing formation material from the formation within a wellbore during operation of the earth-boring tool. As non-limiting examples, cutting structures include rotatable cutting structures, commonly referred to in the art as "roller cones" or "rolling cones."

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to rotatable cutting structures, such as roller cones.

As used herein, any relational term, such as "first," "second," "top," "bottom," "upper," "lower," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Some embodiments of the present disclosure include a hybrid earth-boring tool having both blades and at least one rotatable cutting structure assembly. The blades of the earth-boring tool may include extended gage lengths, and the earth-boring tool may further include a stabilizing structure (i.e., stabilizing pad) secured to a crown of the earth-boring tool. The stabilizing structure may be located on the crown at a location above a leg of the at least one rotatable cutting structure assembly. In one or more embodiments, the stabilizing structure may be circumferentially aligned with the leg of the rotatable cutting structure assembly along a circumference of the crown of the body of the earth-boring tool. For example, the stabilizing structure may be aligned with the rotatable cutting structure assembly along a longitudinal axis of the earth-boring tool. Furthermore, a longitudinal axis of the leg of the at least one rotatable cutting structure assembly, which is parallel to the longitudinal axis of the earth-boring tool, may intersect at least a portion of the at least one stabilizing structure.

One or more embodiments of the present disclosure include a hybrid earth-boring tool having a stabilizing structure that is discrete from the plurality of blades. Additional embodiments of the present disclosure include a hybrid earth-boring tool having a stabilizing structure that extends from at least one blade of the plurality of blades. For example, the stabilizing structure may extend helically from a blade of the plurality of blades.

FIG. 1 is a schematic diagram of an example of a drilling system 100 (i.e., earth-boring tool) that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disk. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank 208 and/or crown 210 of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2:
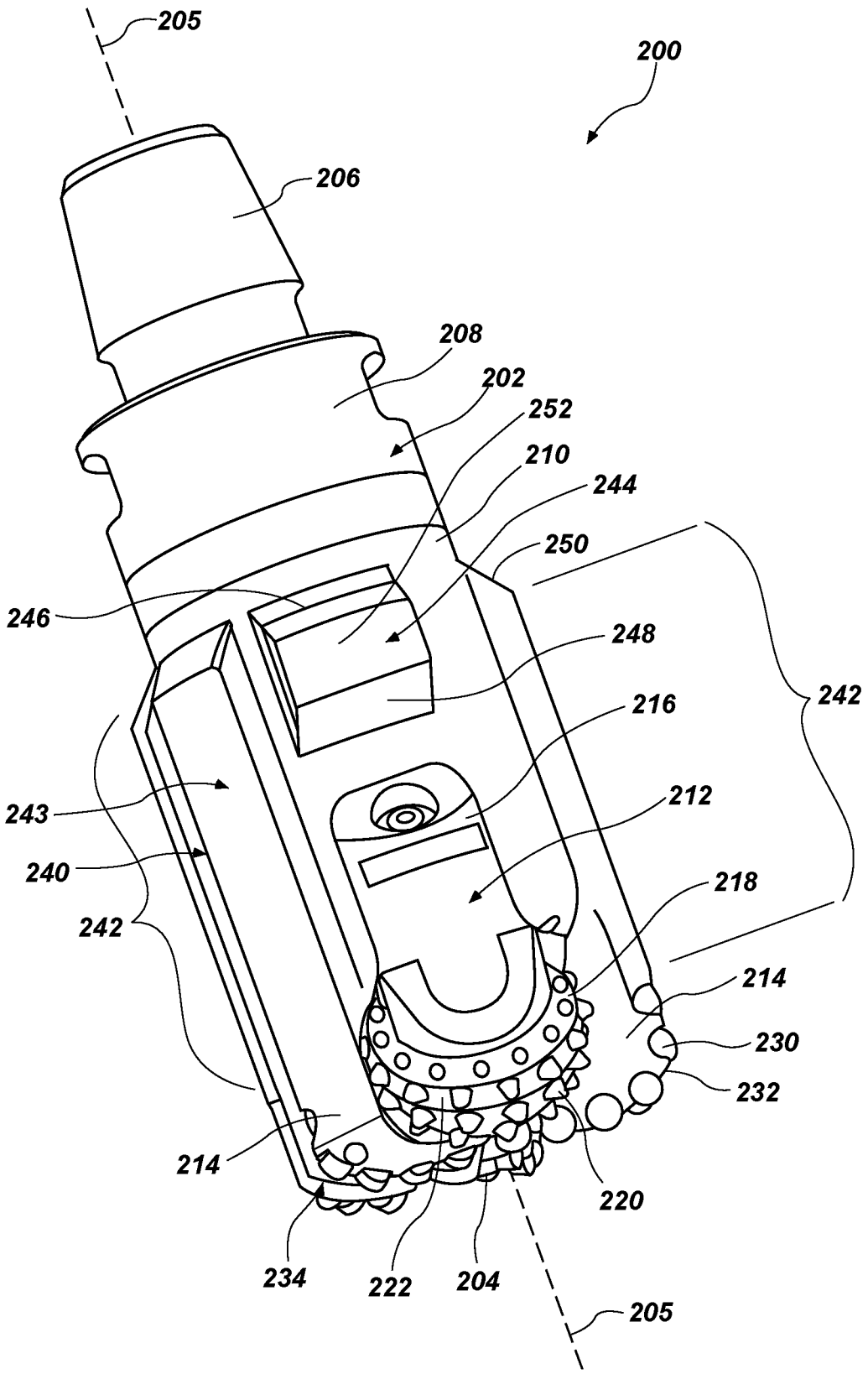
FIG. 2 is a perspective view of an earth-boring tool according to one or more embodiments of the present disclosure.

FIG. 2 is a perspective view of an earth-boring tool 200 that may be used with the drilling assembly 114 of FIG. 1 according to one or more embodiments of the present disclosure. The earth-boring tool 200 may comprise a drill bit having at least one rotatable cutting structure in the form of a roller cone and one or more blades. For example, the earth-boring tool 200 may be a hybrid bit (e.g., a drill bit having both roller cones and blades) as shown in FIG. 2. Furthermore, the earth-boring tool 200 may include any other suitable drill bit or earth-boring tool 200 having the at least one rotatable cutting structure and one or more blades for use in drilling and/or enlarging a borehole 102 in a formation 118 (FIG. 1).

The earth-boring tool 200 may comprise a body 202 including a pin 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center 204 defining a center longitudinal axis 205 that may generally coincide with a rotational axis of the earth-boring tool 200. The center longitudinal axis 205 of the body 202 may extend in a direction hereinafter referred to as an "axial direction."

The body 202 may be connectable to a drill string 110 (FIG. 1). For example, the pin 206 of the body 202 may have a tapered end having threads thereon for connecting the earth-boring tool 200 to a box end of a drilling assembly 114 (FIG. 1). The shank 208 may include a straight section of constant diameter that is fixedly connected to the crown 210 at a joint. In some embodiments, the crown 210 may include at least one rotatable cutting structure assembly 212 and a plurality of blades 214 (e.g., two, three, four, five, six, or seven blades).

Each blade 214 of the plurality of blades 214 of the earth-boring tool 200 may include a plurality of cutting elements 230 fixed thereto. The plurality of cutting elements 230 of each blade 214 may be located in a row along a profile of the blade 214 proximate a rotationally leading face 232 of the blade 214. In some embodiments, the plurality of cutting elements 220 of the plurality of rotatable cutting structures 218 (e.g., roller cutters) and the plurality of cutting elements 230 of the plurality of blades 214 may include polycrystalline diamond compact (PDC) cutting elements 230. Moreover, the plurality of cutting elements 220 of the plurality of rotatable cutting structures 218 and the plurality of cutting elements 230 of the plurality of blades 214 may include any suitable cutting element configurations and materials for drilling and/or enlarging boreholes.

The at least one rotatable cutting structure assembly 212 may include a leg 216 and a rotatable cutting structure 218 mounted to the leg 216. For example, the rotatable cutting structure 218 may be mounted to the leg 216 with one or more of a journal bearing and a rolling-element bearing. Many such bearing systems are known in the art and may be employed in embodiments of the present disclosure. The leg 216 may extend from an end of the body 202 opposite the pin 206 and may extend in the axial direction. In some embodiments, the at least one rotatable cutting structure assembly 212 may include a plurality of rotatable cutting structure assemblies 212 with respective legs and rotatable cutting structures. For example, in one or more embodiments, the plurality of rotatable cutting structure assemblies may include a first rotatable cutting structure assembly and a second rotatable cutting structure assembly. Furthermore, the first and second rotatable cutting structure assemblies may be disposed angularly between the blades 214 of the plurality of blades 214. In other words, each of the first and second rotatable cutting structure assemblies may be disposed between blades 214 along a rotational direction of the earth-boring tool 200.

The rotatable cutting structure 218 may have a plurality of cutting elements 220 disposed thereon, such cutting elements commonly referred to in the art as "inserts." In some embodiments, the plurality of cutting elements 220 of the rotatable cutting structure 218 may be arranged in generally circumferential rows on an outer surface 222 of the rotatable cutting structure 218. In other embodiments, the cutting elements 220 may be arranged in an at least substantially random configuration on the outer surface 222 of the rotatable cutting structure 218. In some embodiments, the cutting elements 220 may comprise preformed inserts that are interference fitted into apertures formed in the rotatable cutting structure 218. In other embodiments, the cutting elements 220 of the rotatable cutting structure 218 may be in the form of teeth integrally formed with the material of each of the rotatable cutting structure 218. The cutting elements 220, if in the form of inserts received in apertures in a rotatable cutting structure 218, may be formed from tungsten carbide, and optionally have a distal surface of polycrystalline diamond, cubic boron nitride, or any other wear-resistant and/or abrasive or superabrasive material.

In some embodiments, the rotatable cutting structure 218 may have a general conical shape, with a base end (e.g., wide end and radially outermost end) of the conical shape being mounted to the leg 216 and a tapered end (e.g., radially innermost end) being proximate (e.g., at least substantially pointed toward) the axial center 204 of the body 202 of the earth-boring tool 200.

The rotatable cutting structure 218 may have a rotational axis (e.g., longitudinal axis) about which the rotatable cutting structure 218 may rotate during use of the earth-boring tool 200 in a drilling operation. In some embodiments, the rotational axis of the rotatable cutting structure 218 of may intersect the axial center 204 of the earth-boring tool 200. In other embodiments, the rotational axis of the rotatable cutting structure 218 may be offset from the axial center 204 of the earth-boring tool 200. For example, the rotational axis of the rotatable cutting structure 218 may be laterally offset (e.g., angularly skewed) such that the rotational axis of the rotatable cutting structure 218 does not intersect the axial center 204 of the earth-boring tool 200.

The plurality of blades 214 may also extend from the end of the body 202 opposite the pin 206 and may extend in both the axial and radial directions. Each blade 214 may have multiple, radially extending profile regions as known in the art (cone, nose, shoulder, and gage). In some embodiments, each blade 214 of the plurality of blades 214 may have an extended gage length 242 (e.g., region) (e.g., a portion of the blade 214 extending within the gage region of the earth-boring tool 200 and extending along in the axial direction a longitudinal length of the crown 210 of the earth-boring tool 200). Furthermore, the extended gage length 242 of each blade 214 may extend radially outward and may refine a radially outermost gage surface 243. As is discussed in greater detail below, the gage lengths 242 of the plurality of blades 214 may extend farther along a longitudinal length of the crown 210 of the earth-boring tool 200 than the leg 216 of the at least one rotatable cutting structure assembly 212. In some embodiments, a ratio of a given gage length 242 of the earth-boring tool 200 and a diameter of the earth boring tool 200 may be within a range of about 0.50 and about 1.50. For example, the ratio of a given gage length 242 of the earth-boring tool 200 and a diameter of the earth boring tool 200 may be about 1.10. In one or more embodiments, a length of each gage length 242 may be determined by a minimum length required to properly orient the rotatable cutting structure assembly 212 with respect to adjacent blades 214 and while providing space for required features for leg attachment and the grease pressure compensation system.

In some embodiments, the plurality of rotatable cutting structure assemblies 212 may not include a plurality of legs 216 but may be mounted directed to the crown 210 on the body 202 of the earth-boring tool 200. Fluid courses 234 may be formed between adjacent blades 214 of the plurality of blades 214 and may be provided with drilling fluid by ports located at the end of passages leading from an internal fluid plenum extending through the body 202 from tubular shank 208 at the upper end of the earth-boring tool 200. Nozzles may be secured within the ports for enhancing direction of fluid flow and controlling flow rate of the drilling fluid. The fluid courses 234 extend to junk slots 240 extending axially along the longitudinal side of earth-boring tool 200 between blades 214 of the plurality of blades 214.

The earth-boring tool 200 may further include at least one stabilizing structure 244. The at least one stabilizing structure 244 may be integrally formed with or secured to the crown 210 of the body 202. In some embodiments, the at least one stabilizing structure 244 may be secured to the crown 210 between an end of the leg 216 of the at least one rotatable cutting structure assembly 212 and the shank 208 of the body 202 of the earth-boring tool 200. For example, the at least one stabilizing structure 244 may be secured to the crown 210 at a location above of the leg 216 of the at least one rotatable cutting structure assembly 212. Furthermore, the at least one stabilizing structure 244 may be discrete (e.g., isolated) from the leg 216 of the at least one rotatable cutting structure assembly 212.

In one or more embodiments, the at least one stabilizing structure 244 may be circumferentially aligned with the leg 216 of the at least one rotatable cutting structure assembly 212 along a circumference of the crown 210 of the body 202 of the earth-boring tool 200. For example, the at least one stabilizing structure 244 may be aligned with the at least one rotatable cutting structure assembly 212 along the axial direction of the earth-boring tool 200. Furthermore, a longitudinal axis of the leg 216 of the at least one rotatable cutting structure assembly 212, which is parallel to the longitudinal axis 205 of the earth-boring tool 200, may intersect at least a portion of the at least one stabilizing structure 244.

In some embodiments, the at least one stabilizing structure 244 may include an upper chamfered surface 246 (e.g., edge) that faces the shank 208 of the earth-boring tool 200, an opposite lower chamfered surface 248 that faces the leg 216 of the rotatable cutting structure assembly 212, and an outer gage surface 252 (e.g., a radially outermost surface). Furthermore, each blade 214 of the plurality of blades 214 may include a respective upper chamfered surface 250 extending from a respective end of a gage length 242 of the blade 214 of the plurality of blades 214 (e.g., an end of the blade 214 opposite the distal end of the earth-boring tool 200 and proximate the shank 208 of the earth-boring tool 200). In view of the foregoing, the at least one stabilizing structure 244 may terminate in the same manner as the plurality of blades 214. In one or more embodiments, the upper chamfered surface 246 of the at least one stabilizing structure 244 may be aligned with the upper chamfered surfaces 250 of the blades 214 of the plurality of blades 214 along a direction of rotation of the earth-boring tool 200 about the longitudinal axis 205 of the earth-boring tool 200. Furthermore, the outer gage surface 252 of the at least one stabilizing structure 244 may be at least substantially a same distance from the axial center 204 of the earth-boring tool 200 as the radially outermost gage surfaces 243 of the plurality of blades 214.

Furthermore, in embodiments including a plurality of rotatable cutting structure assemblies 212 (e.g., a first rotatable cutting structure assembly and a second rotatable cutting structure assembly), the earth-boring tool 200 may include a stabilizing structure 244 for each rotatable cutting structure assembly 212 of the plurality of rotatable cutting structure assemblies 212. Additionally, each stabilizing structure 244 may be aligned with a leg 216 of a respective rotatable cutting structure assembly 212.

In some embodiments, the at least one stabilizing structure 244 may include a hardfacing material on an outer surface of the at least one stabilizing structure 244. For example, the at least one stabilizing structure 244 may include a hardfacing material on one or more of the outer gage surface 252 (e.g., the radially outermost surface), the upper chamfered surface 246, the lower chamfered surface 248, and/or a leading edge on the at least one stabilizing structure 244. In some instances, the hardfacing material may cover only a portion of each surface and/or edge of the at least one stabilizing structure 244. In one or more embodiments, the hardfacing material may include chrome, nickel, cobalt, tungsten carbide, diamond, diamond-like-carbon, boron carbide, cubic boron nitride, nitrides, carbides, oxides, borides and alloys hardened by nitriding, boriding, carbonizing or any combination of these materials. The hardfacing material may be applied pure or as a composite in a binder matrix.

In some embodiments, the at least one stabilizing structure 244 of the earth-boring tool 200 may provide advantages over conventional earth-boring tools. For example, the extended gage lengths 242 of the plurality of blades 214 may provide a greater directional stability in lateral drilling applications, and the at least one stabilizing structure 244 of the earth-boring tool 200 may protect the leg 216 of the at least one rotatable cutting structure assembly 212 from back reaming, hanging on ledges, and/or hanging on casing of drilling assembly 114 (FIG. 1). Therefore, the at least one stabilizing structure 244 may enable hybrid bits (i.e., bits including both rotatable cutting structure assemblies and fixed blades) to include extended gage lengths 242 while protecting the legs 216 of rotatable cutting structure assemblies 212.

In one or more embodiments, the lower chamfered surface 248 (e.g., the separation of the at least one stabilizing structure 244 from the leg 216 of the at least one rotatable cutting structure assembly 212 of the earth-boring tool 200) may provide access to a grease reservoir of the leg 216 of the at least one rotatable cutting structure assembly 212 of the earth-boring tool 200.

Figure 3:
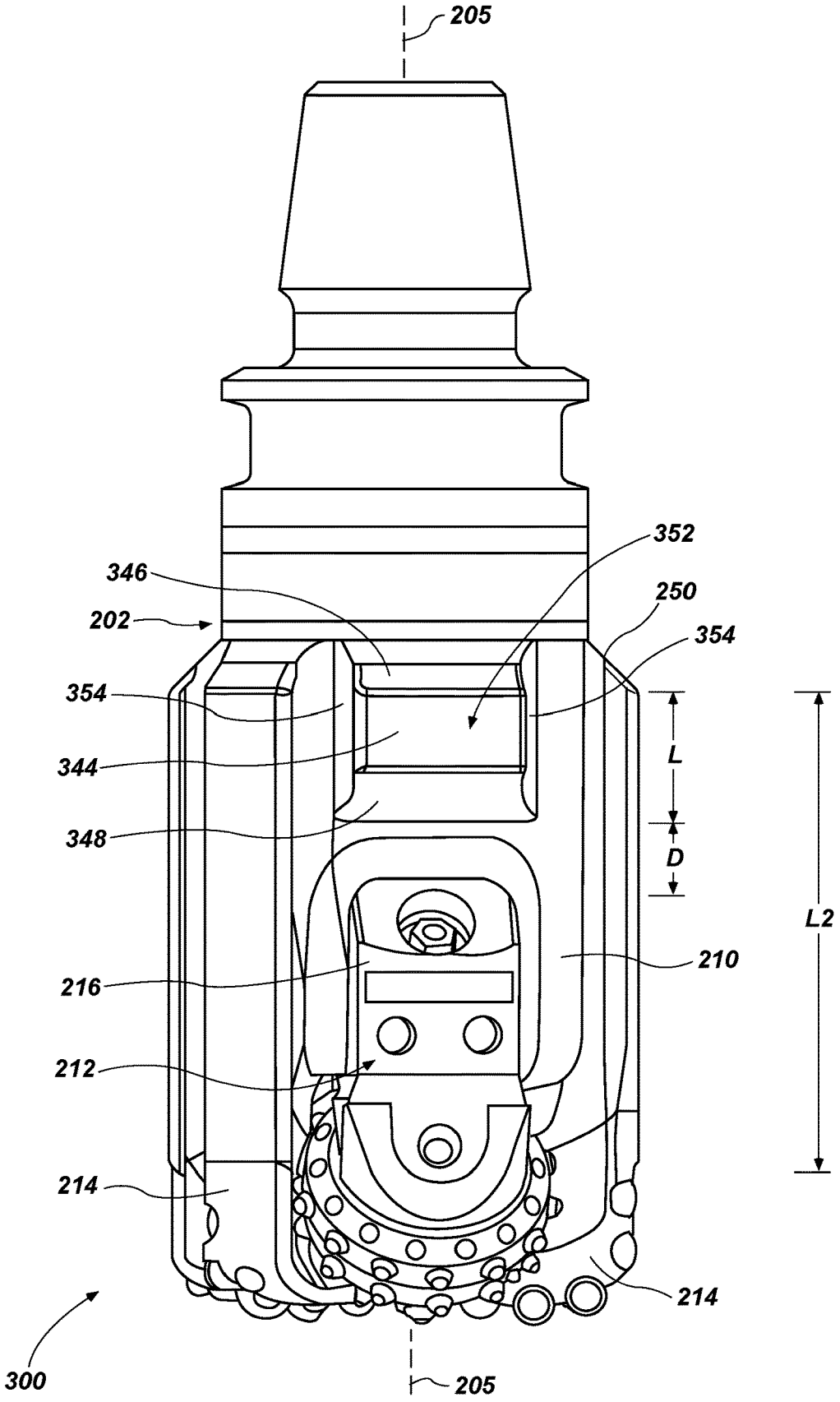
FIG. 3 is a side view of an earth-boring tool according to one or more embodiments of the present disclosure.

FIG. 3 is a side view of an earth-boring tool 300 according to one or more embodiments of the present disclosure. As shown in FIG. 3, in one or more embodiments, a stabilizing structure 344 may be discrete (i.e., isolated) from the plurality of blades 214 of the earth-boring tool 300. For instance, the stabilizing structure 344 may be separated from adjacent blades 214 of the plurality of blades 214 of the earth-boring tool 300.

In some embodiments, the stabilizing structure 244 may have an at least general truncated rectangular pyramid shape having a rectangular base. Furthermore, the stabilizing structure 244 may include an upper chamfered surface 346, a lower chamfered surface 348, and one or more side surfaces 354. In some instances, the one or more side surfaces 354 of the truncated rectangular pyramid shape may be generally curved (i.e., may have a curved surface). Additionally, the one or more side surfaces 354 of the truncated rectangular pyramid shape may be generally flat. In additional embodiments, the stabilizing structure 344 may have a general dome shape. In other embodiments, the stabilizing structure 344 may have a rectangular prism shape. In further embodiments, the stabilizing structure 344 may have a cylindrical shape.

As discussed briefly above, in some embodiments, the stabilizing structure 344 may include a hardfacing material on an outer surface of the stabilizing structure 344. For example, the at least one stabilizing structure 344 may include a hardfacing material on one or more of an outer gage surface 352, the upper chamfered surface 346, the lower chamfered surface 348, and/or a leading edge on the at least one stabilizing structure 344. In some instances, the hardfacing material may cover only a portion of each surface and/or edge of the at least one stabilizing structure 344. In one or more embodiments, the hardfacing material may include any of the hardfacing materials described above in reference to FIG. 2.

In one or more embodiments, the stabilizing structure 344 may have a first length L1 (i.e., a length of the stabilizing structure 344 extending in a direction parallel to the longitudinal axis 205 of the earth-boring tool 300), and each blade 214 of the plurality of blades 214 may have a second length L2 (i.e., a length extending along a gage portion of each blade 214 to the upper chamfered surface 250 of each blade 214). In some embodiments, a ratio of the first length L1 and the second length L2 may be within a range of about 0.30 and about 0.15. For example, in some instances, the ratio of the first length L1 and the second length L2 may be about 0.25.

In some embodiments, the stabilizing structure 344 may be separated from the leg 216 of the at least one rotatable cutting structure assembly 212 by a distance D along a longitudinal axis 205 of the earth-boring tool 300. A ratio of the distance D and the second length L2 of each blade 214 of the plurality of blades 214 may be within a range of about 0.08 and 0.25. For example, the ratio of the distance D and the second length L2 may be about 0.15. In one or more embodiments, D may be the distance necessary to allow access to weld grooves for attaching the legs 216 to the body 202 of the earth-boring tool 100.

As noted above, the stabilizing structure 344 may be circumferentially aligned with the leg 216 of the at least one rotatable cutting structure assembly 212 along a circumference of the crown 210 of the body 202 of the earth-boring tool 200. For instance, the stabilizing structure 344 may be aligned with the at least one rotatable cutting structure assembly 212 along the longitudinal axis 205 of the earth-boring tool 200. For example, in some embodiments, the longitudinal axis of the leg 216 of the at least one rotatable cutting structure assembly 212 may intersect a center of the stabilizing structure 344 relative to a width of the stabilizing structure 344.

Figure 4:
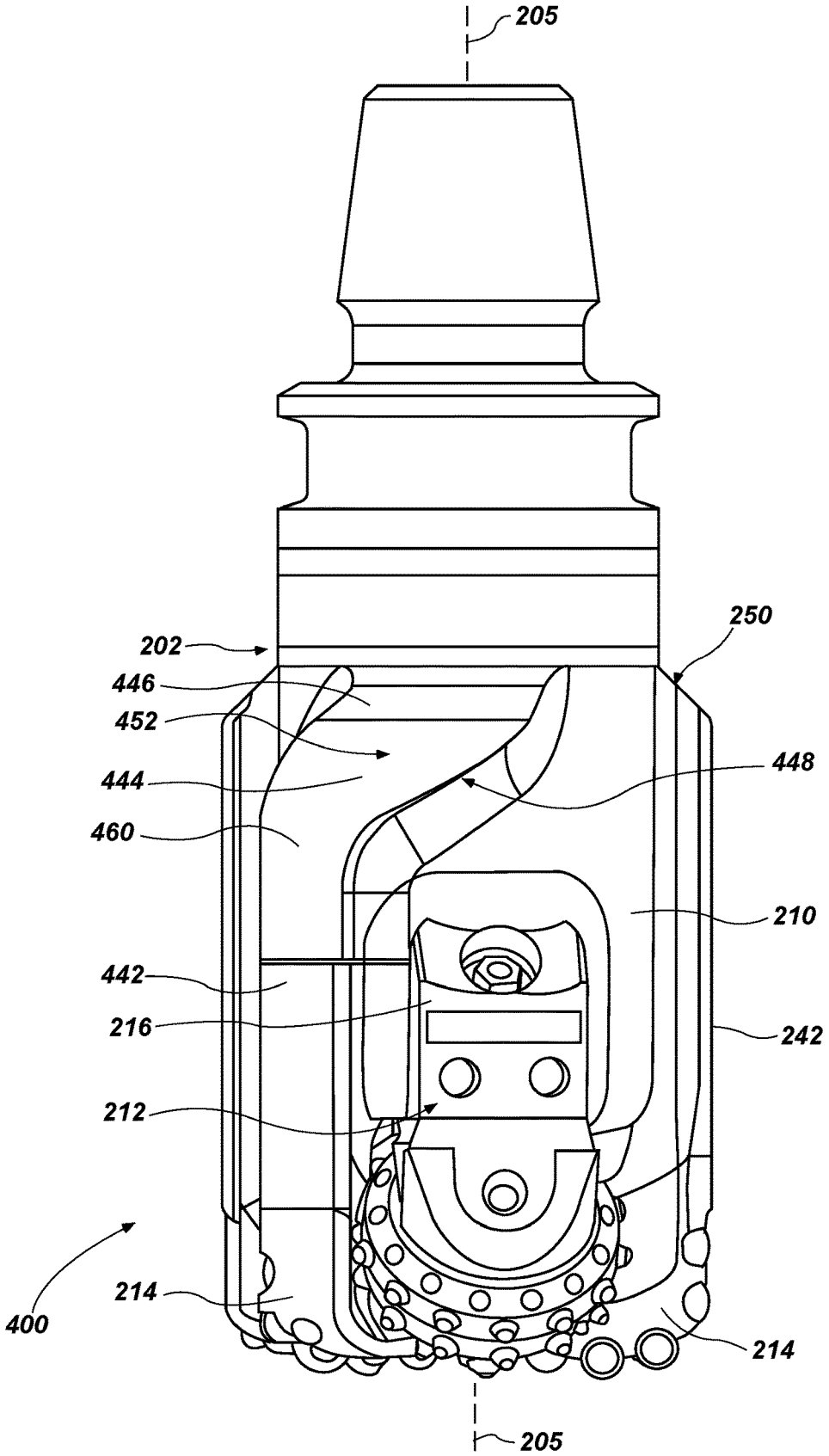
FIG. 4 is a side view of an earth-boring tool according to one or more embodiments of the present disclosure.

FIG. 4 is a side view of an earth-boring tool 400 according to one or more embodiments of the present disclosure. As shown in FIG. 4, in one or more embodiments, the stabilizing structure 444 may be connected to one or more blades 214 of the plurality of blades 214 of the earth-boring tool 400. For example, in some instances, a stabilizing structure 444 may extend from (e.g., may be an integral portion of) a blade 214 of the plurality of blades 214 of the earth-boring tool 400. As a non-limiting example, the stabilizing structure 444 may extend from a trailing edge of a blade 214 of the plurality of blades 214.

In some embodiments, the stabilizing structure 444 may extend helically at least partially around the circumference of the crown 210 of the body 202 of the earth-boring tool 400. In other words, the stabilizing structure 444 may have a form approximating that of a helix. The stabilizing structure 444 may extend around the circumference of the crown 210 of the body 202 at least enough such that a portion of the stabilizing structure 444 may be circumferentially aligned with the leg 216 of the rotatable cutting structure assembly 212 along a circumference of the crown 210 of the body 202 of the earth-boring tool 200. For instance, at least a portion of the stabilizing structure 444 may be aligned with the rotatable cutting structure assembly 212 along the longitudinal axis 205 of the earth-boring tool 400. For example, in some embodiments, the longitudinal axis of the leg 216 of the rotatable cutting structure assembly 212 may intersect at least a portion of the stabilizing structure 444.

In one or more embodiments, the stabilizing structure 444 may be aligned with only a portion of the leg 216 (relative to the width of the leg 216) of the rotatable cutting structure assembly 212 along a circumference of the crown 210 of the body 202 of the earth-boring tool 200. In particular, another portion of the leg 216 may not be aligned with the stabilizing structure 444. For example, in some instances, the stabilizing structure 444 may be aligned with between about 30% and about 100% of the width of the leg 216 of the rotatable cutting structure assembly 212. In additional embodiments, the stabilizing structure 444 may be aligned with between about 50% and about 100% of the width of the leg 216 of the rotatable cutting structure assembly 212. In further embodiments, the stabilizing structure 444 may be aligned with between about 70% and about 100% of the width of the leg 216 of the rotatable cutting structure assembly 212. In yet further embodiments, the stabilizing structure 444 may be aligned with between about 90% and about 100% of the width of the leg 216 of the rotatable cutting structure assembly 212.

The stabilizing structure 444 may extend from the trailing edge of a respective blade 214 of the plurality of blades 214 in a direction at least generally opposite to a direction of rotation of the earth-boring tool 400. In some instances, a blade 214 from which the stabilizing structure 444 extends may have a shortened gage length 442 relative to other blades 214 of the plurality of blades 214, and the stabilizing structure 444 may extend from an upper end 460 of the shortened gage length 442. Furthermore, similar to the stabilizing structure 244 described above in regard to FIG. 2, the stabilizing structure 444 may include an upper chamfered surface 446 that is aligned with the upper chamfered surfaces 250 of the gage lengths 242 of the other blades 214 of the plurality of blades 214 along a direction of rotation of the earth-boring tool 400 about the longitudinal axis 205 of the earth-boring tool 400. In view of the foregoing, in some embodiments, the stabilizing structure 444 may form a portion of the shortened gage length 442 of the blade 214.

As discussed briefly above, in some embodiments, the stabilizing structure 444 may include a hardfacing material on an outer surface of the stabilizing structure 444. For example, the at least one stabilizing structure 444 may include a hardfacing material on one or more of an outer gage surface 452, a lower chamfered surface 448, and/or a leading edge on the at least one stabilizing structure 444. In some instances, the hardfacing material may cover only a portion of each surface and/or edge of the at least one stabilizing structure 444. In one or more embodiments, the hardfacing material may include any of the hardfacing materials described above in reference to FIG. 2.

Furthermore, although the stabilizing structure 444 is described herein as extending helically around the crown 210 of the earth-boring tool 400, the stabilizing structure 444 may extend in any manner around crown 210 of the earth-boring tool 400.

Referring to FIGS. 2-4 together, although the earth-boring tools are shown with a particular number of blades and rotatable cutting structure assemblies, the disclosure is not so limited. Rather, the earth-boring tool 200 may include fewer or more blades, and the earth-boring tools of the present disclosure may include fewer or more rotatable cutting structure assemblies.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An earth-boring tool, comprising:

a body comprising a shank and a crown;

a plurality of blades protruding from the crown of the body and extending at least substantially along a longitudinal length of the crown of the body, each blade extending radially outward from the crown and defining a respective radially outermost gage surface;

at least one rotatable cutting structure assembly coupled to the crown of the body and comprising:

a leg extending from the body of the earth-boring tool; and a rotatable cutting structure rotatably coupled to the leg; and at least one stabilizing structure secured to the crown of the body between an end of the leg opposite the rotatable cutting structure and the shank of the body, the at least one stabilizing structure extending outward radially from the crown and being at least substantially circumferentially aligned with the leg of the at least one rotatable cutting structure assembly along a circumference of the crown of the body, wherein the at least one stabilizing structure extends from at least one of the plurality of blades.

2. The earth-boring tool of claim 1, wherein a radially outermost surface of the stabilizing structure is at least substantially a same distance from a center longitudinal axis of the earth-boring tool as the radially outermost gage surfaces of the plurality of blades.

3. The earth-boring tool of claim 1, wherein the at least one rotatable cutting structure assembly comprises:

a first rotatable cutting structure assembly coupled to the crown of the body and comprising:

a first leg extending from the body of the earth-boring tool; and a first rotatable cutting structure rotatably coupled to the first leg; and a second rotatable cutting structure assembly coupled to the crown of the body and comprising:

a second leg extending from the body of the earth-boring tool; and a second rotatable cutting structure rotatably coupled to the second leg.

4. The earth-boring tool of claim 1, wherein the plurality of blades comprises at least four blades.

5. The earth-boring tool of claim 1, wherein the at least one stabilizing structure extends from at least one of the plurality of blades and extends helically at least partially around a circumference of crown.

6. The earth-boring tool of claim 1, further comprising a plurality of cutting elements secured within each blade of the plurality of blades of the earth-boring tool.

7. The earth-boring tool of claim 1, wherein the rotatable cutting structure of the at least one rotatable cutting structure assembly has a general conical shape.

8. An earth-boring tool, comprising:

a body comprising a shank and a crown;

a plurality of blades protruding from the crown of the body and extending at least substantially along a longitudinal length of the crown of the body, each blade extending radially outward from the crown and defining a respective radially outermost gage surface;

a first rotatable cutting structure assembly coupled to the crown of the body and comprising:

a first leg extending from the body of the earth-boring tool; and a first rotatable cutting structure rotatably coupled to the first leg;

a second rotatable cutting structure assembly coupled to the crown of the body and comprising:

a second leg extending from the body of the earth-boring tool; and a second rotatable cutting structure rotatably coupled to the second leg;

a first stabilizing structure secured to the crown of the body between an end of the first leg opposite the first rotatable cutting structure and the shank of the body, the first stabilizing structure extending outward radially from the crown and being at least substantially circumferentially aligned with the first leg of the first rotatable cutting structure assembly along a circumference of the crown of the body, wherein the first stabilizing structure extends from at least one of the plurality of blades; and a second stabilizing structure secured to the crown of the body between an end of the second leg opposite the second rotatable cutting structure and the shank of the body, the second stabilizing structure extending outward radially from the crown and being at least substantially circumferentially aligned with the second leg of the second rotatable cutting structure assembly along the circumference of the crown of the body.

9. The earth-boring tool of claim 8, wherein the first stabilizing structure comprises a chamfered surface facing in a direction toward the shank of the earth-boring tool.

10. The earth-boring tool of claim 9, wherein the first stabilizing structure comprises a width at least substantially the same as a width of a blade of the plurality of blades.

11. The earth-boring tool of claim 8, wherein the first stabilizing structure comprises a width larger than a width as the first leg.

12. The earth-boring tool of claim 8, wherein the first stabilizing structure extends from at least one of the plurality of blades and extends helically at least partially around a circumference of the crown.

13. The earth-boring tool of claim 8, further comprising cutting elements secured to the first and second rotatable cutting structures.

14. The earth-boring tool of claim 8, further comprising one or more junk slots defined between adjacent blades of the plurality of blades.

15. A method of forming an earth-boring tool, comprising:

forming a body of the earth-boring tool comprising a shank and a crown;

forming the body to have a plurality of blades protruding from the crown of the body and extending at least substantially along a longitudinal length of the crown of the body;

coupling a rotatable cutting structure to a leg of a rotatable cutting structure assembly of the earth-boring tool; and forming at least one stabilizing structure on the crown of the body between an end of the leg opposite the rotatable cutting structure and the shank of the body, the at least one stabilizing structure extending outward radially from the crown and being at least substantially circumferentially aligned with the leg of the rotatable cutting structure assembly along a circumference of the crown of the body, wherein the at least one stabilizing structure extends from at least one of the plurality of blades.

* * * * *